US006312306B1

(12) United States Patent
Kroll

(10) Patent No.: US 6,312,306 B1
(45) Date of Patent: Nov. 6, 2001

(54) GYROSCOPE AND METHOD AND APPARATUS FOR SPINNING SAME

(76) Inventor: Frederick H. Kroll, 11289 Piping Rock Dr., Boynton Beach, FL (US) 33437-1631

( * ) Notice: Subject to any disclaimer, the term of this patent is extended or adjusted under 35 U.S.C. 154(b) by 0 days.

(21) Appl. No.: 09/550,534

(22) Filed: Apr. 17, 2000

(51) Int. Cl.[7] ..... A63H 1/00
(52) U.S. Cl. ..... 446/233; 446/259
(58) Field of Search ..... 446/233, 234, 446/235, 236, 259

(56) References Cited

U.S. PATENT DOCUMENTS

| | | | | |
|---|---|---|---|---|
| 755,446 | * | 3/1904 | Butcher | 446/233 |
| 1,351,630 | * | 8/1920 | Edison | 446/233 |
| 2,195,083 | * | 3/1940 | Einfalt | 446/234 |
| 2,762,162 | * | 9/1956 | Doljan | 446/233 |
| 3,224,142 | | 12/1965 | Pawelka et al. . | |
| 3,945,146 | | 3/1976 | Brown . | |
| 4,408,413 | * | 10/1983 | Hyland et al. | 446/259 X |
| 4,453,342 | | 6/1984 | Sahar . | |
| 4,713,039 | | 12/1987 | Wong . | |
| 5,026,057 | | 6/1991 | Watford . | |
| 5,518,437 | | 5/1996 | Nonaka et al. . | |
| 5,593,338 | | 1/1997 | Itoh et al. . | |
| 5,683,284 | | 11/1997 | Christen . | |

* cited by examiner

*Primary Examiner*—John A. Ricci
(74) *Attorney, Agent, or Firm*—Akerman Senterfitt

(57) ABSTRACT

A gyroscope includes first and second rings positioned orthogonally concentric to one another, an axle mounted for free rotation extending diametrically through the first ring, a rotary disk fixedly attached to the axle, and an engagement structure coaxially aligned with the axle which is fixedly attached to the axle. An apparatus for spinning a gyroscope includes a housing, a compartment within the housing for receiving at least a portion of the gyroscope, and a motor within the housing for transmitting rotational energy to the gyroscope. The apparatus can include a lid having an open position and a closed position, and an electrical contact disposed in the compartment. The electrical contact can be switchable between open and closed conditions. The lid can be configured to urge the gyroscope downwardly into the receptacle and switch the electrical contact to the closed condition when the lid is in the closed position. A method for spinning a gyroscope includes the steps of providing a housing having a motor and a compartment for receiving at least a portion of the gyroscope, placing at least a portion of the gyroscope within the compartment, and transmitting rotational energy to the gyroscope with the motor.

24 Claims, 7 Drawing Sheets

GYROSCOPE AND METHOD AND APPARATUS FOR SPINNING SAME

CROSS REFERENCE TO RELATED APPLICATIONS (Not Applicable)

STATEMENT OF FEDERALLY SPONSORED RESEARCH AND DEVELOPMENT (Not Applicable)

BACKGROUND OF THE INVENTION

1. Field of the Invention

The present invention relates generally to gyroscopes. More particularly, the invention relates to an improved gyroscope and an improved method and apparatus for spinning a gyroscope.

2. Description of the Related Art

The traditional gyroscope includes an axle and a rotary disk mounted for free rotation about the axle. The traditional gyroscope is set into rotational motion by a string, serrated flat gear, or by hand. When sufficient rotational speed is obtained, the gyroscope can perform "tricks" such as walking along a taut string or wire, or balancing on a spindle-like support. Imparting the high rotational speed to the gyroscope which is necessary for such tricks requires a degree of skill on the part of the user, and can be extremely difficult to master.

Itoh et al., U.S. Pat. No. 5,593,338, and Nonaka et al., U.S. Pat. No. 5,518,437, both disclose devices which mechanically spin a top toy. These devices are spring-wound, and require the user to manually wind the top toy prior to spinning the top toy.

The present invention overcomes the disadvantages of the prior art by providing a gyroscope which includes structure for engaging a spinning apparatus. The present invention also provides a spinning apparatus utilizing a motor, thereby imparting greater rotational speed to a gyroscope than the spring-wound devices of the prior art.

SUMMARY OF THE INVENTION

It is an object of the invention to provide an improved gyroscope and a method and apparatus for spinning the gyroscope.

It is another object of the invention to provide a method and apparatus for imparting sufficient rotational energy to a gyroscope to spin the gyroscope independently of the apparatus.

It is yet another object of the invention to provide an apparatus for spinning a gyroscope which can include surfaces on which the gyroscope can rotate.

To achieve these and other objects, a gyroscope and a method and apparatus for spinning a gyroscope are provided. The gyroscope, according to the invention, includes first and second rings positioned orthogonally concentric to one another, an axle mounted for free rotation extending diametrically through the first ring, a rotary disk fixedly attached to the axle, and engagement structure coaxially aligned with the axle which is fixedly attached to the axle. The engagement structure can be integrally formed with the rotary disk, and adapted to engage with a structure for spinning the axle. Preferably, the engagement structure is one or more gears.

A method of spinning a gyroscope according to the invention can include the steps of providing a gyroscope having a rotatable axle shaft, an engagement structure which is fixedly attached to the axle shaft, and a structure to engage with the engagement structure. The method also includes the step of imparting rotational energy to the structure to spin the gyroscope.

The apparatus, according to the invention, includes a housing, a compartment within the housing for receiving at least a portion of a gyroscope, and a motor within the housing for transmitting rotational energy to the gyroscope. The motor can include a rotating drive shaft and structure adapted to engage with the rotating drive shaft.

The housing can include a lid having an open position and a closed position, and a securing mechanism to secure the lid in the closed position. The compartment can have a receptacle adapted to receive a portion of the gyroscope. The compartment preferably has a configuration which is complementary to the portion of the gyroscope that it receives.

An electrical contact switchable between open and closed conditions is preferably disposed in the receptacle. The insertion of a gyroscope into the receptacle can close the electrical contact, thereby providing electrical power for actuating the motor. The lid can be configured to urge the gyroscope downwardly into the receptacle. Urging the gyroscope downwardly into the receptacle can close the electrical contact when the lid is in the closed position. The gyroscope can also be manually urged downwardly into the receptacle to close the electrical contact and actuate the motor.

The housing can include a leg portion extending outwardly from the receive the rotational tip of a gyroscope after a gyroscope has been set into rotational motion. The housing can also have platforms adapted to provide playing surfaces for a gyroscope after the gyroscope has been set into rotational motion. The platforms can be connected to appendages extending outwardly from the housing. The platforms can be detachably connected to the appendages.

The method of spinning a gyroscope includes the steps of providing a housing, providing a compartment within the housing for receiving at least a portion of the gyroscope, and transmitting rotational energy to the gyroscope with a motor. The method can also include the steps of providing a lid having an open position and a closed position, and providing a securing mechanism to secure the lid in the closed position.

The method according to the invention can further include the steps of providing a compartment which includes a receptacle adapted to receive a portion of a gyroscope which has a complementary configuration to a portion of the gyroscope, providing an electrical contact switchable between open and closed conditions which is disposed in the receptacle, and closing the electrical contact to provide electrical power for actuating the motor by insertion of a gyroscope into the receptacle.

The method can also include the step of configuring the lid to urge the gyroscope downwardly into the receptacle to close the electrical contact when the lid is in the closed position. The method can further include the step of manually urging the gyroscope downwardly into the receptacle to close the electrical contact.

The method can also include the steps of providing a leg portion extending outwardly from the housing, and providing a groove on the upper surface of the leg portion adapted to receive the rotational tip of the gyroscope after the gyroscope has been set into rotational motion. Platforms can be appended to the housing. The platforms can be adapted to provide playing surfaces for a gyroscope after the gyroscope has been set into rotational motion.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
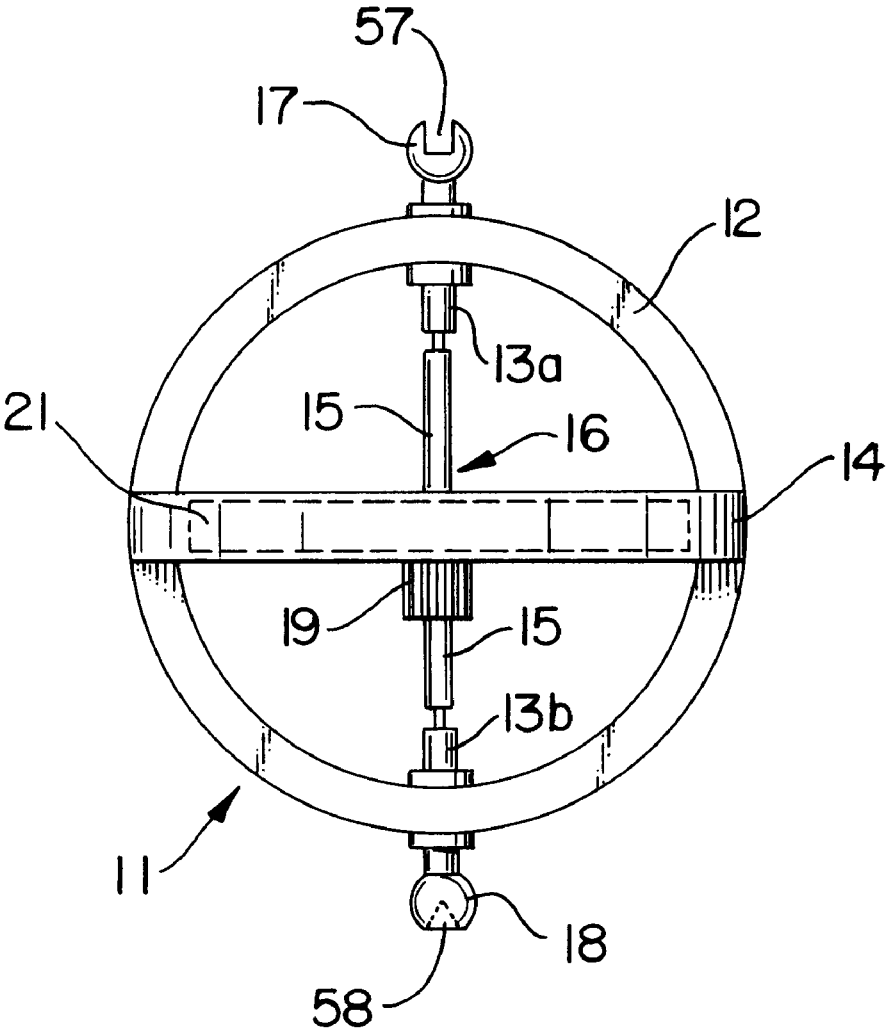
FIG. 1 is an illustration of a gyroscope according to the invention.

FIG. 1 illustrates a gyroscope 11 according to the invention. The gyroscope 11 can include a first ring 12 and a second ring 14. The first and second rings 12, 14 can be integrally formed and positioned orthogonally concentric to one another. An axle assembly 16 can extend diametrically through the first ring 12. The axle assembly 16 can include axle mounts 13*a*, 13*b* which terminate at upper and lower rotational tips 17, 18. An axle shaft 15 can be mounted for free rotation between axle mounts 13*a*, 13*b*. A rotary disk 21 can be fixedly attached to the center of the axle shaft 16 to be coincident with the second ring 14.

The gyroscope 11 preferably includes an engagement structure 19 which can be fixedly attached to the axle shaft 15. The illustrated embodiment includes a single engagement structure 19, however a plurality of engagement structures can be utilized. The engagement structure 19 is preferably a gear, however, any suitable structure may be used. The engagement structure 19 is preferably adapted to engage with a structure which can transmit rotational energy to the axle shaft 15. In the preferred embodiment of the invention, the engagement structure 19 can be adapted to engage with the rotational structure of a spinning apparatus.

The engagement structure 19 can be coaxially mounted on the axle shaft 15. In the illustrated embodiment, the engagement structure 19 is fixedly attached to the rotary disk 21. The engagement structure 19 can be integrally formed with rotary disk 21.

The upper and lower rotational tips 17, 18 can have any suitable configuration which will allow the gyroscope 11 to balance on the upper and lower rotational tips 17, 18 while spinning freely. The upper and lower rotational tips 17, 18 are preferably approximately semispherical in shape. The configuration of upper and lower rotational tips 17 and 18 can be adapted to allow the gyroscope 11 to spin on various support surfaces. In the illustrated embodiment, the upper rotational tip 17 includes a slot 57 which allows the gyroscope 11 to be placed on a structure such as a taut string or wire, and the lower rotational tip 18 includes a conical indentation 58 to allow the gyroscope to be placed on a pointed object.

Figure 2:
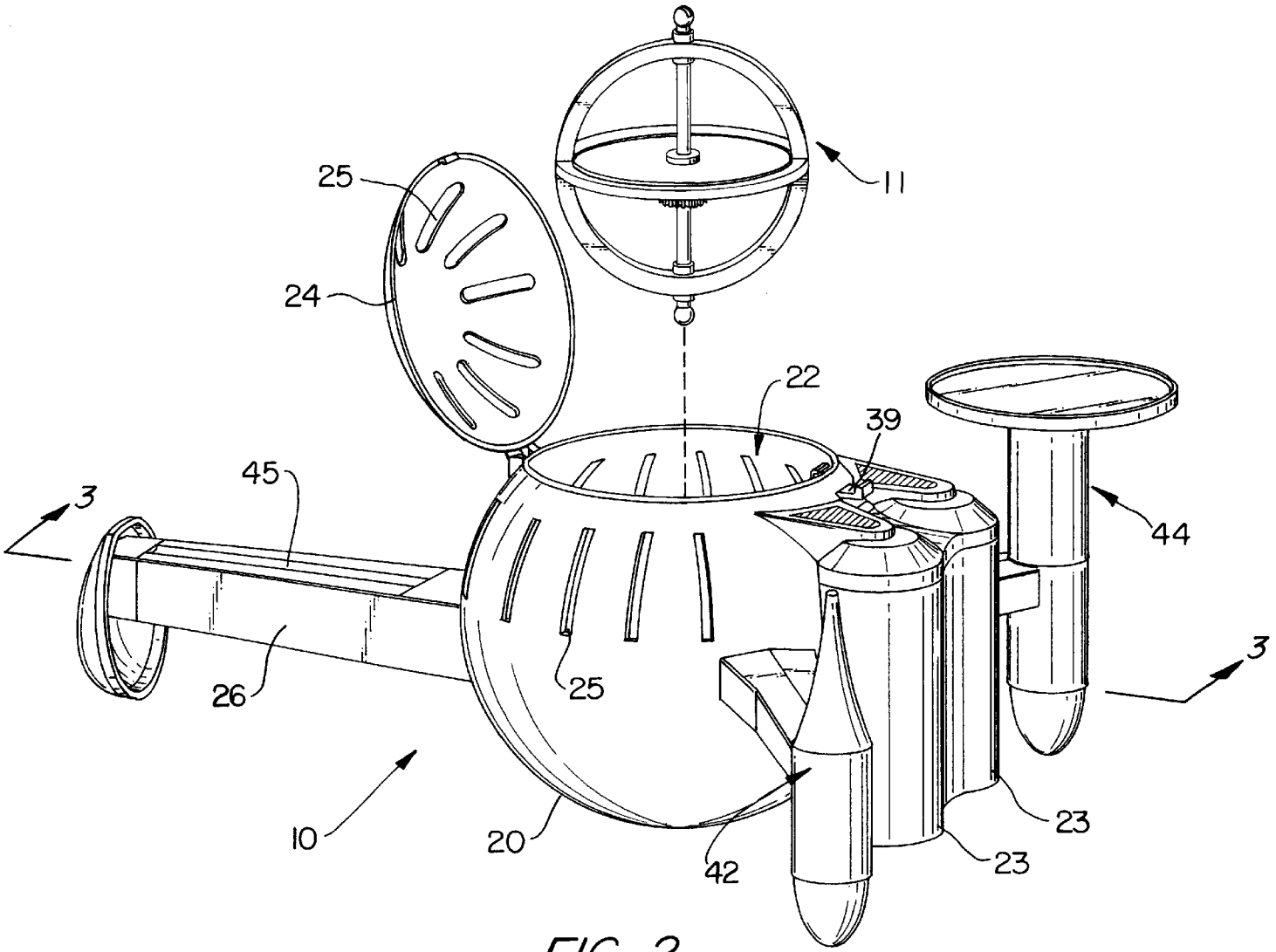
FIG. 2 is an exploded perspective view of a spinning apparatus according to the invention with the gyroscope of FIG. 1.

FIG. 2 illustrates a spinning apparatus 10 according to a preferred embodiment of the invention. The spinning apparatus 10 includes a housing 20, which is preferably constructed of a durable material, such as plastic. The housing 20 is preferably constructed of interfitting components. In the embodiment illustrated in FIGS. 2–5, the housing 20 has been fashioned to have the fanciful appearance of a "spaceship" type object, however, the invention is not limited in that regard.

The housing 20 preferably includes a compartment 22 adapted to receive any gyroscope, including the gyroscope 11 according to the invention. The compartment 22 can have a lid 24, although the invention is not limited in that regard. If the compartment 22 has a lid, the compartment 22 can be accessed by the opening of a lid 24. The lid 24 can be detachably connected to the housing 20 with any suitable structure. For example, the lid 24 can be hinged to the housing 20. The housing can also have a securing mechanism 39, such as a latch, which can engage with the lid 24 to secure the lid 24 in a closed position. Any suitable securing mechanism 39 can be used.

A motor (not shown), preferably a battery operated motor, can be enclosed in the housing 20. A battery housing 23 can be appended to the housing 20, and can also serve as a support for the spinning apparatus 10. One or more leg portions 26 can extend from the housing 20 and can also support the spinning apparatus 10. The housing can include openings 25 through which the gyroscope 11 can be viewed when the gyroscope 11 is inserted inside of the housing 20.

Figure 3A:
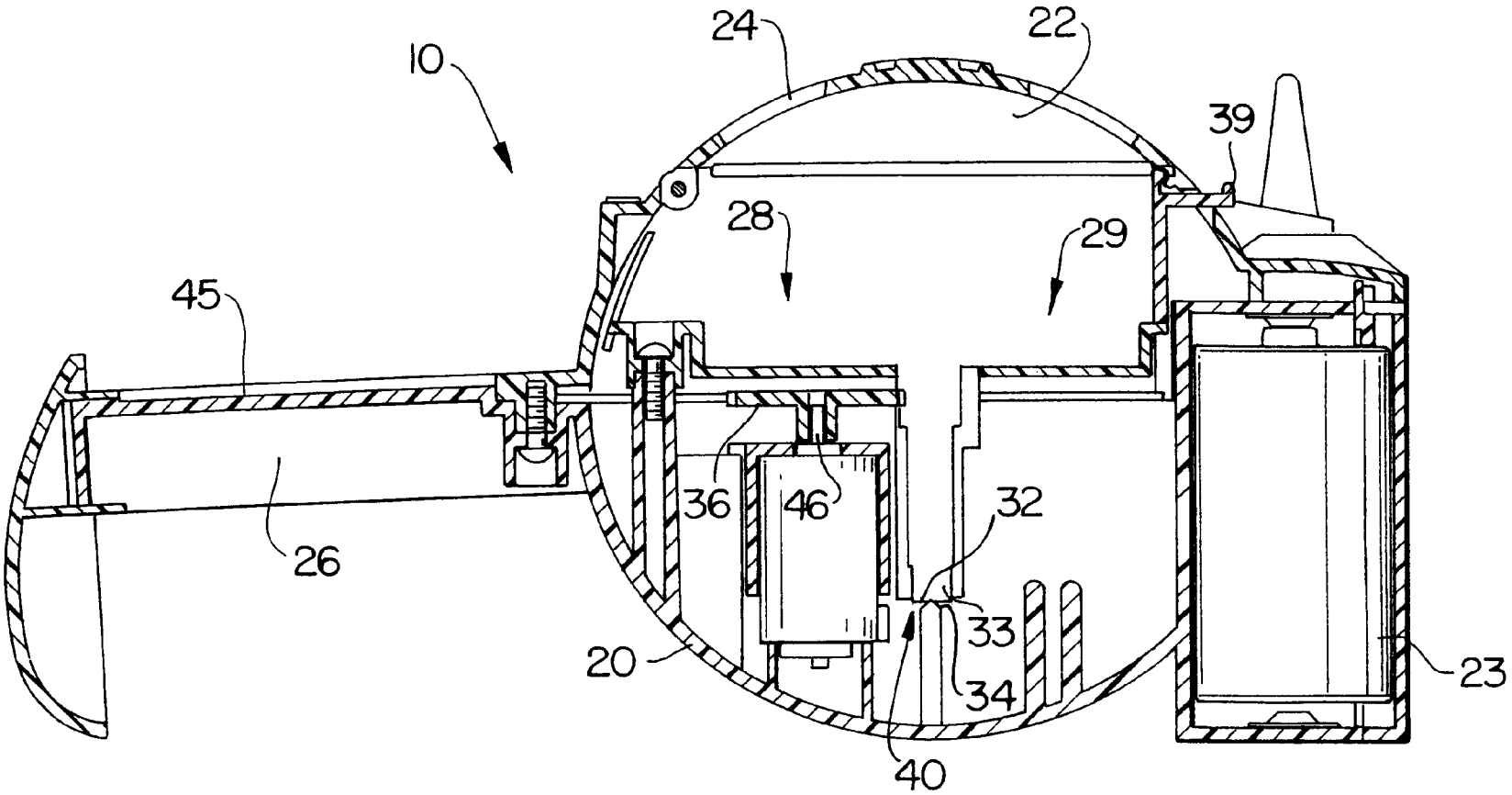
FIG. 3*a* is a cross-sectional view of a spinning apparatus according to the invention, taken along the line 3—3 of FIG. 2.
Figure 4:
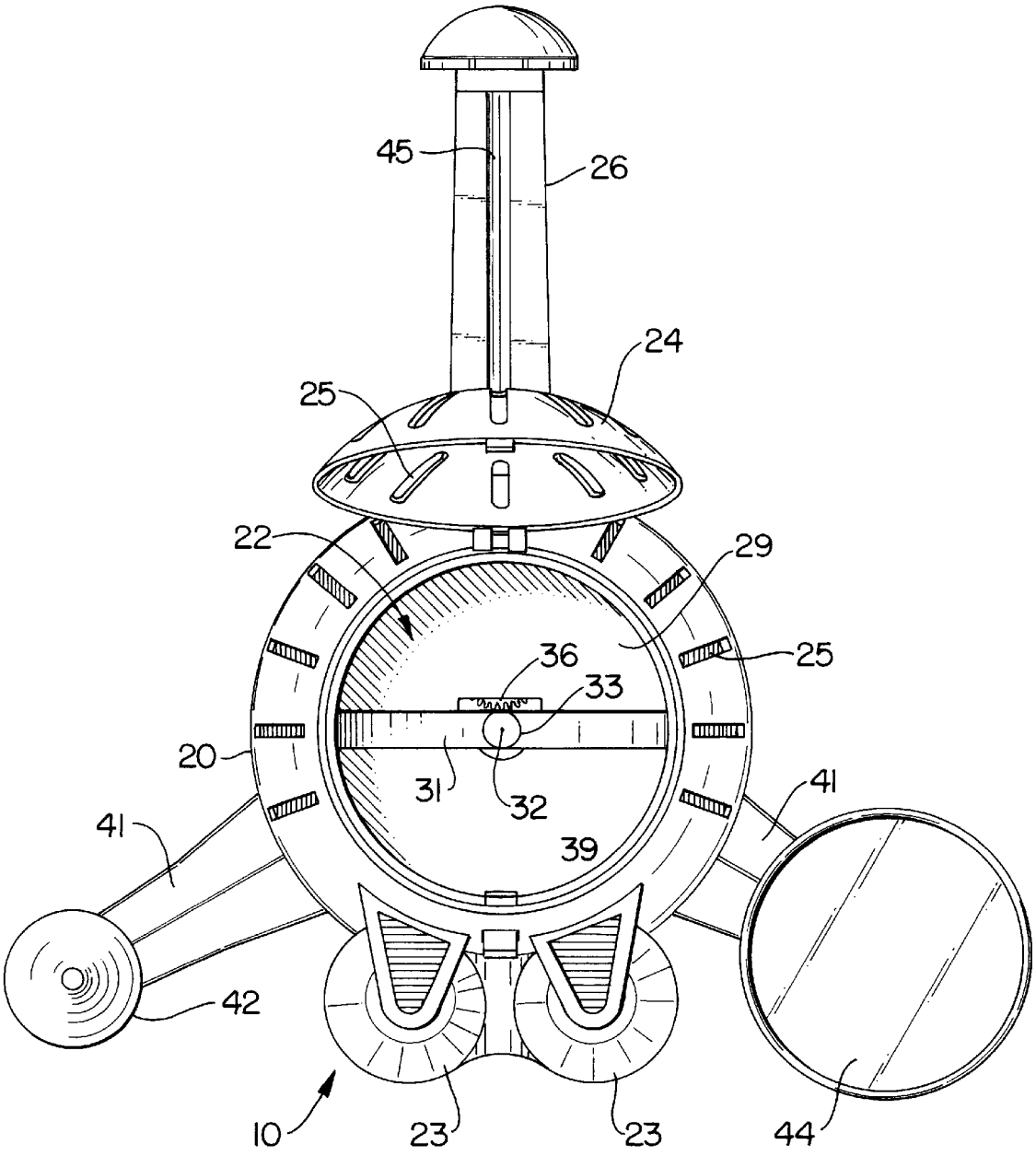
FIG. 4 is a top plan view of the spinning apparatus of FIG. 2 with a lid in an open configuration.

FIGS. 3*a* and 4 show the compartment 22 having a receptacle 28 adapted to receive the gyroscope 11. The receptacle 28 preferably has a complementary configuration to the lower half of the gyroscope 11 to permit close engagement. In a preferred embodiment, the receptacle 28 preferably includes a horizontally-oriented cylindrical recess 29 adapted to receive the second ring 14, and a vertically oriented slot 31 adapted to receive the first ring 12. The slot 31 is preferably semicircular and can extend diametrically through the cylindrical recess 29.

When the gyroscope 11 is inserted in the compartment 22, the second ring 14 can be seated in the receptacle 28 such that the rotary disk 21 of the gyroscope 11 can rotate freely. A recess 33 within the slot 31 can receive the lower rotational tip 18 of the gyroscope 11, and preferably includes an electrical contact 40 switchable between open and closed positions. The electrical contact 40 can include an upper contact switch 32 and a lower contact switch 34. The electrical contact 40 is preferably closed by the full insertion of the gyroscope 11 to engage upper contact switch 32 with lower contact switch 34.

Figure 3B:
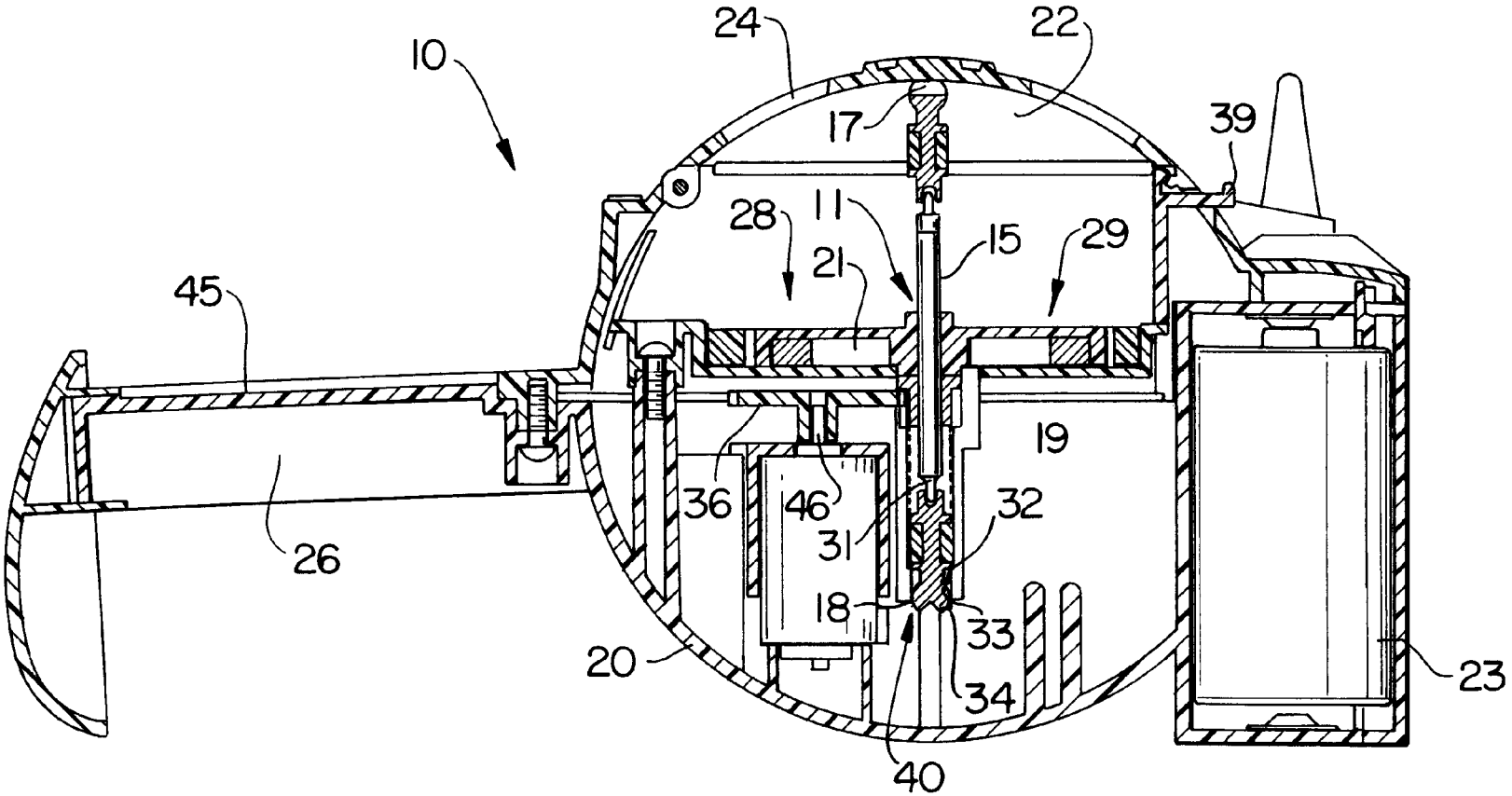
FIG. 3*b* is a cross-sectional view of a spinning apparatus according to the invention with the gyroscope of FIG. 1 inserted therein, taken along the line 3—3 of FIG. 2.

After the gyroscope 11 has been inserted into the slot 31, a driving gear 36 located proximate to the slot 31 can meshingly engage with the engagement structure 19. FIG. 3*b* illustrates the gyroscope 11 inserted into the receptacle 28 of the spinning apparatus 10.

The spinning apparatus 10 preferably includes a motor 38. Any suitable motor 38, such as a direct current motor, can be enclosed in the housing 20. The motor 38 can be configured to be in electrical communication with batteries which may be enclosed within the battery housing 23. Any suitable structure can be used to transmit rotational energy from the motor 38 to the rotary disk 21. For example, the motor 38 can include a drive shaft 46 which operates the driving gear 36.

After the initial insertion of the gyroscope 11 into the receptacle 28, the lower rotational tip 29 can contact the upper switch portion 32 of the electrical contact 40 located at the base of the recess 33. When the gyroscope 11 is urged downwardly into the recess 33, the upper switch portion 32 can engage with the lower switch portion 34 to close the electrical contact 40 and activate the motor 38. Power can thus be transmitted to the drive gear 36 and the gyroscope gear 19 to spin the rotary disk 21. The motor 38 is preferably capable of rotating the rotary disk 21 at a speed of at least 20,000 rpm, and can preferably accelerate to this speed in approximately 10–20 seconds.

The compartment 22 is preferably dimensioned such that the inner surface of the lid 24 contacts the upper rotational tip 17 when the lid 24 is in the closed and secured position. The action of closing the lid 24 preferably urges the gyroscope 11 downward a sufficient distance to engage the upper switch portion 32 with the lower switch portion 34 to activate the motor 38. When the lid 24 is secured in the closed position, the gyroscope 11 is preferably positioned within the recess 33 such that the electrical contact 40 remains closed. Alternatively, the gyroscope 11 can be manually urged downwardly into the receptacle 28 until the motor 38 is activated by closure of electrical contact 40. The gyroscope 11 can then be manually held in this position to maintain the motor 38 in an actuated state.

In operation, the gyroscope 11 is inserted into the spinning apparatus 10. The user preferably orients the gyroscope 11 to permit engagement of the engagement structure 19 with the gear 36 upon insertion. The gyroscope 11 can thus be inserted into the receptacle 28 and positioned so that the lower rotational tip is seated in the recess 33. As previously indicated, the user can then actuate the motor 38 by either closing the lid 24, or by manually pushing the gyroscope 11 downward into the receptacle 24. After the motor 38 is actuated, the gyroscope 11 can be allowed to spin for the desired time interval. The gyroscope 11 can then be removed from the spinning apparatus 10 and balanced on either of the upper or lower rotational tips 17, 18, on any suitable support surface. The rotational speed of the rotary disk 21 causes the gyroscope 11 to "walk" along a smooth surface, such as a floor or table top. The configuration of the upper and lower rotational tips 17, 18 also allows the gyroscope 11 to be placed on a taut wire, or to be balanced on a spindle-like projection. After the gyroscope has 11 been removed from the spinning apparatus 10, the gyroscope 11 can spin until the rotational energy is exhausted or otherwise halted. The spinning apparatus 10 of the present invention advantageously imparts greater rotational energy to the rotary disk 21 of the gyroscope 11 than could be achieved by traditional manual spinning methods. This greater rotational energy allows the user to readily perform a wide variety of maneuvers with the gyroscope 11, and also maintains the gyroscope 11 in a freely rotating state for a significant interval of time, preferably as long as 60–90 seconds.

While rotating, the gyroscope 11 can be placed on a variety of support surfaces. For example, the gyroscope 11 can be placed on any suitable planar support surface. The conical indentation 58 in the lower rotational tip 18 allows the gyroscope 11 to be balanced on any pointed object having suitable dimensions, such as a pencil point or a pen. The slot 57 in upper rotational tip 17 allows the gyroscope 11 to be placed on a taut line, wire or narrow vertical edge during rotation.

Figure 5:
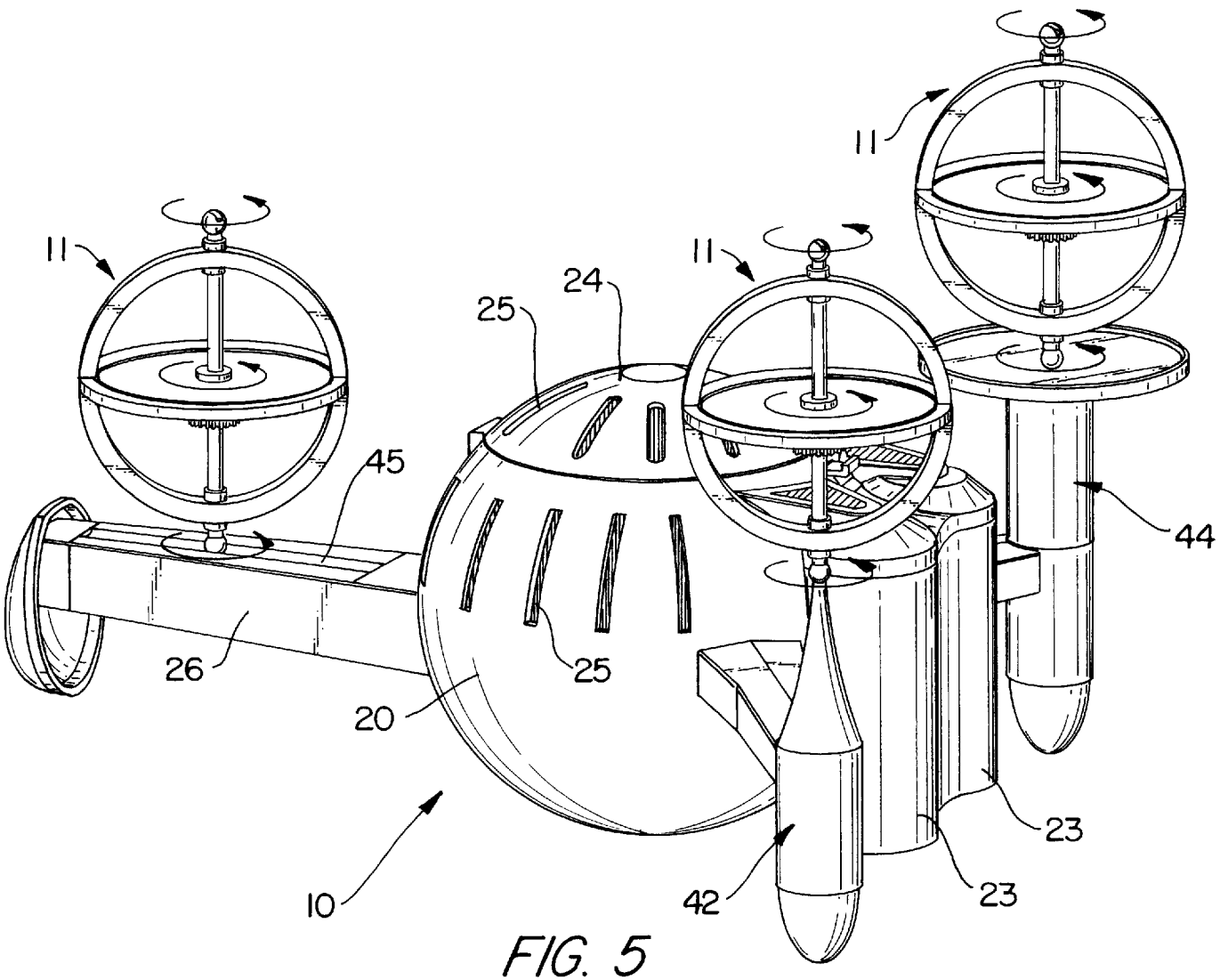
FIG. 5 is a perspective view of a spinning apparatus according to the invention with the gyroscope of FIG. 1 rotating on three surfaces of the spinning apparatus.

In a further aspect of the invention, the housing 20 of the spinning apparatus 10 can include projections or appendages which function as surfaces on which the gyroscope 11 can spin. The housing 20 of the spinning apparatus 10 preferably includes vertical oriented platforms adapted to receive the gyroscope 11 after the gyroscope 11 has been set into rotational motion. Referring again to FIG. 4, it can be is seen that the housing 20 includes outwardly extending appendages 41. Appendages 41 are preferably attachable to vertically-oriented platforms. The illustrated embodiment shown in FIGS. 2, 4 and 5 shows two such platforms, however, the invention is not limited in the types or number of platforms or other structures which may be appended to housing 20. A first platform 42 can be a vertical spindle on which the gyroscope 11 can be balanced. A second platform 44 can be a flat circular mirror surface having a slightly raised rim. The platforms are preferably detachable from the housing 20 to allow for interchangeability. To provide yet another surface on which the gyroscope 11 can be rotated, the upper surface of the leg portion 26 can include a lateral groove 45 into which the gyroscope 11 can be placed. The gyroscope 11 can then traverse the length of the groove 45.

In FIG. 5, the gyroscope 11 is illustrated on the first platform 42, the second platform 44, and the groove 45. In addition to the platforms illustrated and described herein, the invention contemplates a wide variety of interchangeable attachments and extensions which can provide surfaces for rotation of the gyroscope.

Figure 6:
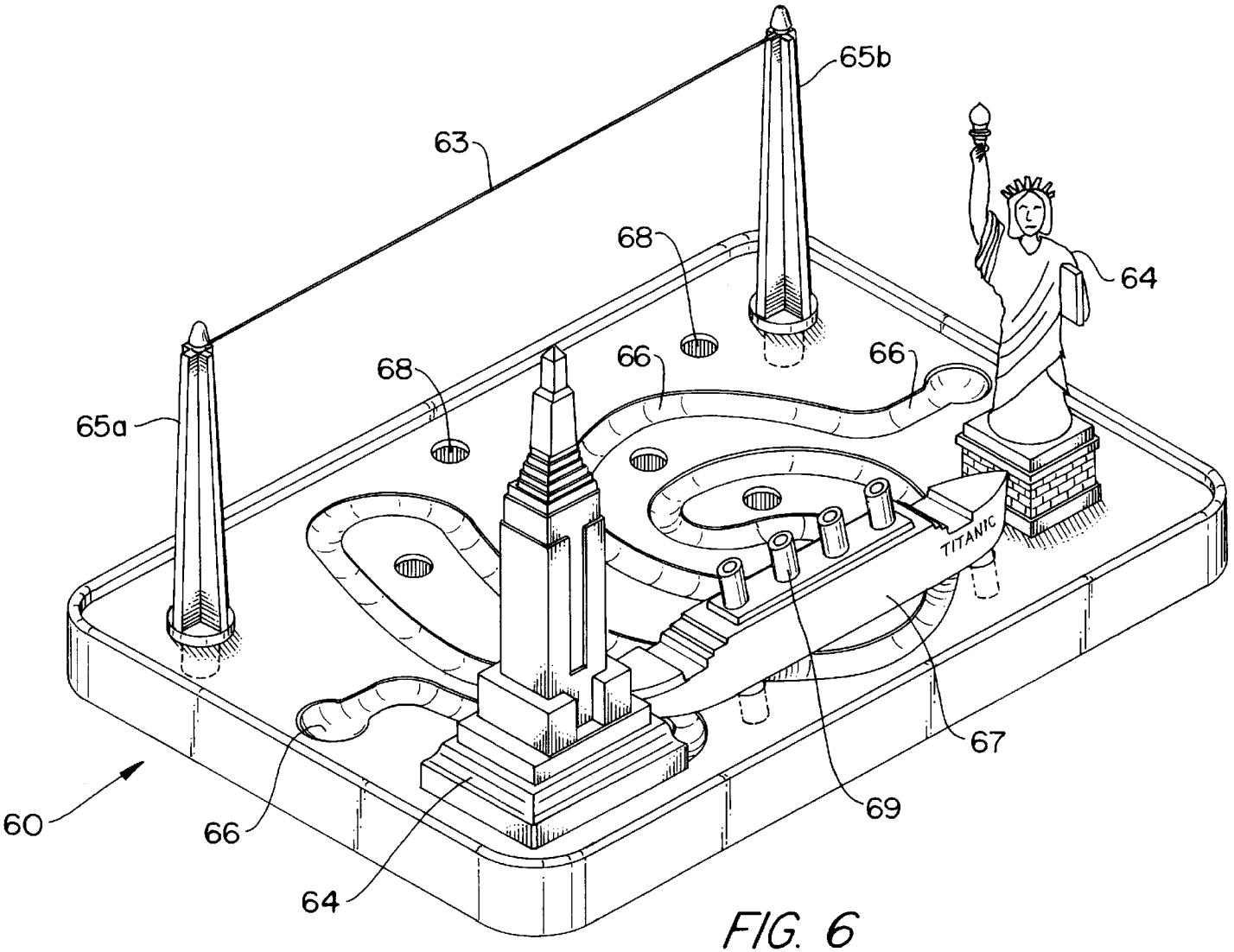
FIG. 6 is an illustration of a track on which the gyroscope of FIG. 1 can be rotated.

In yet another aspect of the invention, the invention can include a board for the gyroscope 11, as illustrated in FIG. 6. The board 60 has a top surface 62 which can include an arcuate groove forming a track 66. The user can place upper or lower rotational tips 17, 18 of the gyroscope 11 into the track 66 and then guide the gyroscope through the track 66 by manually tilting the board 60. The track 66 can form any suitable pattern on the surface 62, including a random path, geometric shapes, a maze, or a recognizable image. The board 60 can also include spindles 64 on which the gyroscope 11 can be balanced. To enhance the entertainment value of the invention, the spindles can be in the form of recognizable objects. In the illustrated embodiment, the spindles 64 are in the form of representations of the Empire State Building and the Statue of Liberty. The board 60 can also include line supports 65*a* and 65*b* which support a line 63. Line 63 can be wire, string, nylon line, or any suitable material, and is preferably tautly attached between line supports 65*a* and 65*b*. The gyroscope 11 can be placed on line 63 by aligning slot 57 of the gyroscope 11 with line 63. The board 60 can include other structures which provide supports for the gyroscope 11, such as structure 67 shown in the illustrated embodiment. In the illustrated embodiment, structure 67 is in the form of a representation of a ocean liner, which includes a plurality of vertical extensions 69 adapted to receive the upper and lower rotational tips 17, 18 of the gyroscope 11.

Spindles 64, line supports 65*a* and 65*b*, and structure 67 are preferably detachable from board 66. The board 66 preferably includes a plurality of bores 68 which are adapted to receive spindles 64, line supports 65*a* and 65*b*, and playing structure 67. Spindles 64, line supports 65*a* and 65*b*, and structure 67 can include peg extensions which allow insertion into the bores 68.

The invention is capable of taking a number of specific forms without departing from the spirit or essential attributes thereof. Accordingly, the following claims should be referenced to determine the scope of the invention, rather than the foregoing specification.

What is claimed is:

1. An apparatus for spinning a gyroscope, comprising:

a housing;

a compartment within said housing for receiving at least a portion of the gyroscope; and a motor within said housing for transmitting rotational energy to the gyroscope.

2. The apparatus of claim 1, wherein said compartment further comprises a lid, said lid having an open position and a closed position.

3. The apparatus of claim 1, wherein said housing further comprises a securing mechanism which engages with said lid to secure the lid in the closed position.

4. The apparatus of claim 2, further comprising an electrical contact disposed in said receptacle, said electrical contact switchable between open and closed conditions.

5. The apparatus of claim 4, wherein insertion of the gyroscope into said receptacle switches said electrical contact to said closed condition, thereby providing electrical power for actuating said motor.

6. The apparatus of claim 2, further comprising an electrical contact disposed in said compartment, said electrical contact switchable between open and closed conditions; and wherein said lid is configured to urge the gyroscope downwardly into said receptacle and switch said electrical contact to said closed condition when said lid is in said closed position.

7. The apparatus of claim 1, wherein said compartment comprises a receptacle adapted to receive said portion of the gyroscope, said receptacle having a complementary configuration to said portion of the gyroscope.

8. The apparatus of claim 1, wherein said housing further comprises at least one leg portion extending outwardly from said housing, said leg portion having an upper surface; and wherein said upper surface of said leg portion includes a groove adapted to receive the rotational tip of the gyroscope after the gyroscope has been set into rotational motion.

9. The apparatus of claim 1, wherein said housing further comprises platforms adapted to provide playing on which the gyroscope can rotate after the gyroscope has been set into rotational motion.

10. The apparatus of claim 9, wherein said platforms are connected to appendages extending outwardly from said housing.

11. The apparatus of claim 10, wherein said platforms are detachable from said appendages.

12. The apparatus of claim 1, wherein said motor has a rotating drive shaft and engagement structure for engaging said rotating drive shaft.

13. A method for spinning a gyroscope, comprising the steps of:

providing a housing having a motor and a compartment for receiving at least a portion of the gyroscope;

placing at least a portion of the gyroscope within the compartment; and transmitting rotational energy to the gyroscope with the motor.

14. The method of claim 13, further comprising the step of providing a lid having an open position and a closed position.

15. The method of claim 14, further comprising the step of providing a securing mechanism on the housing to secure the lid in the closed position.

16. The method of claim 14, further comprising the step of configuring the lid to urge the gyroscope downwardly into the receptacle to close the electrical contact when the lid is in the closed position.

17. The method of claim 13, further comprising the step of providing a compartment having a receptacle adapted to receive at least a portion of the gyroscope, the receptacle having a complementary configuration to the portion of the gyroscope.

18. The method of claim 17, further comprising the step of providing an electrical contact disposed in the receptacle, the electrical contact switchable between open and closed conditions.

19. The method of claim 18, further comprising the step of closing the electrical contact, thereby providing electrical power for actuating the motor.

20. The method of claim 18, further comprising the step of manually urging the gyroscope downwardly into the receptacle to close the electrical contact, thereby providing electrical power for actuating the motor.

21. The method of claim 13, further comprising the step of providing at least one leg portion extending outwardly from the housing, and a groove on an upper surface of the at least one leg portion adapted to receive the rotational tip of a gyroscope after the gyroscope has been set into rotational motion.

22. The method of claim 13, further comprising the step of connecting at least one platform to the housing, wherein the platform is adapted to provide a surface on which the gyroscope can rotate after the gyroscope has been set into rotational motion.

23. The method of claim 13, further comprising the step of providing at least one appendage which extends outwardly from the housing and at least one platform which is detachably connected to the appendages.

24. The method of claim 13, wherein the motor has a rotating drive shaft and engagement structure for engaging the rotating drive shaft.

* * * * *